US005467183A

United States Patent [19]

Snelling

[11] Patent Number: 5,467,183

[45] Date of Patent: Nov. 14, 1995

[54] ELECTROSTATIC COLOR PRINTING SYSTEM WITH SONIC TONER RELEASE DEVELOPMENT

[75] Inventor: Christopher Snelling, Penfield, N.Y.

[73] Assignee: Xerox Corporation, Stamford, Conn.

[21] Appl. No.: 283,366

[22] Filed: Aug. 1, 1994

[51] Int. Cl.[6] ..... G03G 15/01

[52] U.S. Cl. ..... 355/326 R; 118/653

[58] Field of Search ..... 355/245, 259, 355/326 R, 327, 328; 118/645, 653

[56] References Cited

U.S. PATENT DOCUMENTS

| | | | |
|---|---|---|---|
| 3,140,199 | 7/1964 | York | 118/653 |
| 4,302,094 | 11/1991 | Gundlach et al. | 118/653 X |
| 4,794,878 | 1/1989 | Connors et al. | 118/653 |
| 4,833,503 | 5/1989 | Snelling | 355/259 |
| 5,255,059 | 10/1993 | Kai et al. | 355/245 X |
| 5,305,070 | 4/1994 | Snelling | 355/326 R |

*Primary Examiner*—William J. Royer

[57] ABSTRACT

An electrophotographic printing machine adapted to print a document in at least two different colors. An electrostatic latent image is recorded on the photoconductive member. A non-interactive development system is employed to develop the latent image. The developing system includes a first toner carrying piezoelectric polymer belt for conveying toner of a first color to the latent image on the photoconductive member and a second toner carrying piezoelectric polymer belt for conveying toner of a second color to the latent image. A first developer activation stylus selectively vibrates toner carrying surface areas of the first toner carrying piezoelectric polymer belt to develop a first portion of the latent image with the first color. A second developer activation stylus selectively vibrates toner carry surface areas of the second toner carrying piezoelectric polymer belt to develop a second portion of the latent image with the second color.

16 Claims, 4 Drawing Sheets

FIG. 2A
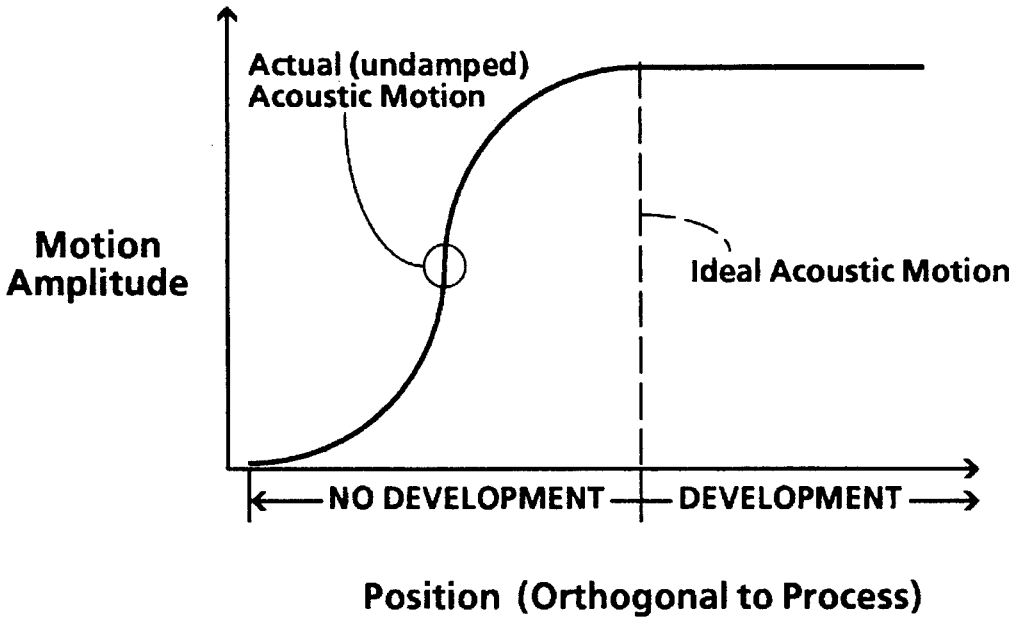
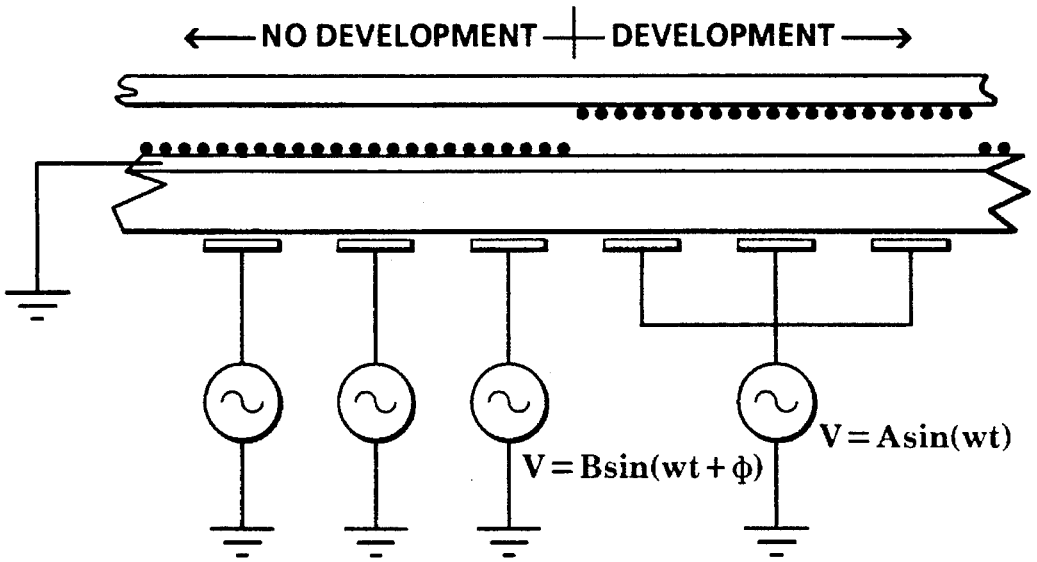
FIG. 2B

FIG. 3
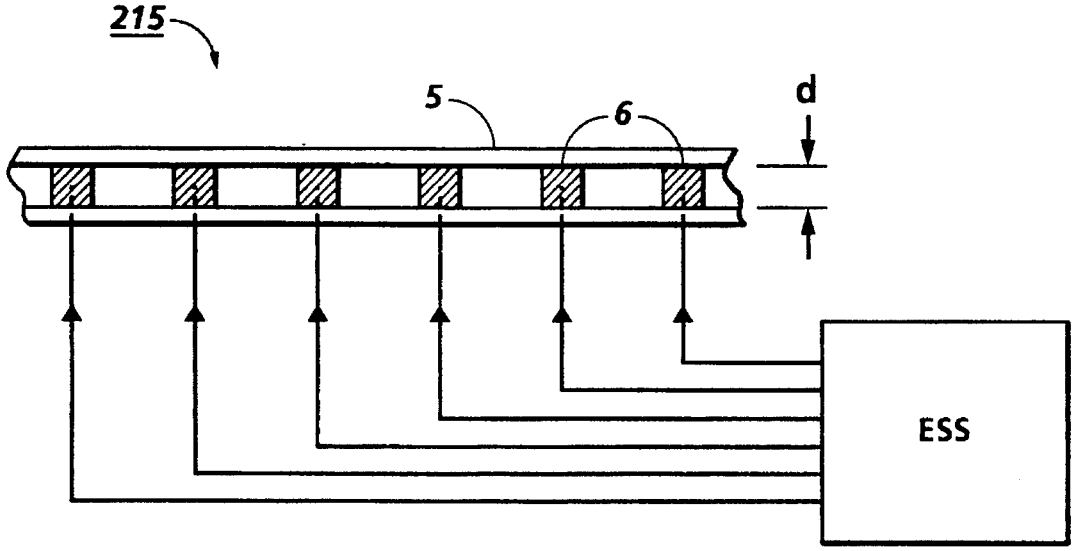
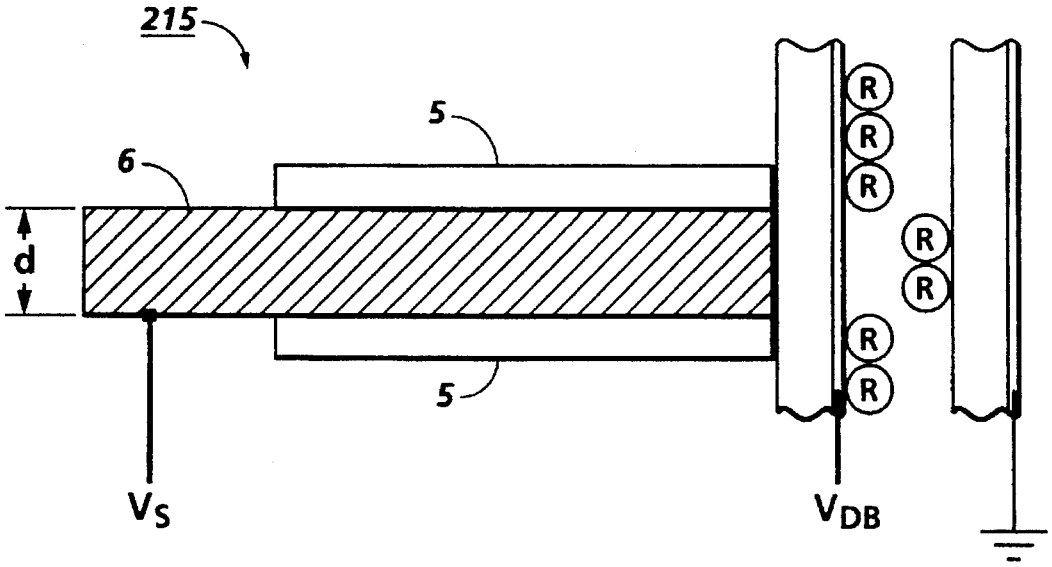
FIG. 4

ELECTROSTATIC COLOR PRINTING SYSTEM WITH SONIC TONER RELEASE DEVELOPMENT

This invention relates generally to an electrophotographic printing machine, and more particularly concerns a printing machine adapted to print a document in at least two different colors.

In the process of electrophotographic printing, a photoconductive surface is charged to a substantially uniform potential. The photoconductive surface is imagewise exposed to record an electrostatic latent image corresponding to the informational areas of an original document being reproduced. Alternatively, a light beam, such as a laser beam may be modulated to expose the charged portion of a photoconductive surface selectively, thereby recording a latent image thereon. In either case, information is recorded as an electrostatic latent image on the photoconductive surface. Thereafter, a developer material is transported into contact with the electrostatic latent image. Typical developer materials include carrier granules having toner particles adhering triboelectrically thereto. The toner particles are attracted from the carrier granules of the developer material onto the latent image. The resultant toner powder image is then transferred from the photoconductive surface to a sheet and permanently affixed thereto. The foregoing generally describes a typical mono-color electrophotographic printing machine.

Recently, electrophotographic printing machines had been developed which produce highlight color copies. A typical highlight color printing machine records successive electrostatic latent images on the photoconductive surface. When combined, these electrostatic latent images form a latent image corresponding to the entire original document being printed. One latent image is usually developed with black toner particles. The other latent image is developed with color highlighting toner particles, e.g. red toner particles. These developed toner powder images are transferred sequentially to a sheet to form a color highlighted document. A color highlighting printing machine of this type is a two-pass machine. Single pass highlight color printing machines using tri-level printing have also been developed. Tri-level electrophotographic printing is described in greater detail in U.S. Pat. No. 4,078,929. As described in this patent, the latent image is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, relatively negative and relatively positively charged toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image and improves color sharpness.

In tri-level electrophotographic printing, the charge on the photoconductive surface is divided in three, rather than two, ways as is the case in mono-color printing. The photoconductive surface is charged and exposed imagewise such that one image corresponds to the charged areas and remains at the full charged potential. The other image, which corresponds to discharged image areas, is exposed to discharge the photoconductive surface to its residual potential. The background areas are exposed to reduce the photoconductive surface potential to about halfway between the charged and discharged potentials. A developer unit arranged to develop the charged images is typically biased to a potential between the background potential and the full potential. The developer unit arranged to develop the discharged imaged areas is typically biased to a level between the background potential and the discharged potential. The single pass nature of this system dictates that the electrostatic latent image passes through the developer unit in a serial fashion. Another type of printing machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and imagewise exposed to record the highlight color portions of the latent image thereon. A highlight latent image is then developed with toner particles of a color other than black, e.g. red. Thereafter, both toner powder images are transferred to a sheet and subsequently fused thereto to form a highlight color document. Various types of printing machines have hereinbefore been used as illustrated by the following disclosures, which may be relevant to certain aspects of the present invention.

U.S. Pat. No. 4,403,848, Patentee: Snelling, Issued: Sep. 13, 1983.

U.S. Pat. No. 4,660,059, Patentee: O'Brien, Issued: Apr. 21, 1987.

U.S. Pat. No. 4,761,672, Patentee: Parker et al., Issued: Aug. 2, 1988.

U.S. Pat. No. 4,771,314, Patentee: Parker et al., Issued: Sep. 13, 1988.

U.S. Pat. No. 4,833,503, Patentee: Snelling, Issued: May 23, 1989.

U.S. Pat. No. 4,833,504, Patentee: Parker et al., Issued: May 23, 1989.

U.S. Pat. No. 4,937,636, Patentee: Rees et al., Issued: Jun. 26, 1990.

U.S. Pat. No. 4,984,021, Patentee: Williams, Issued: Jan. 8, 1991.

U.S. Pat. No. 4,990,955, Patentee: May et al., Issued: Feb. 5, 1991.

U.S. Pat. No. 4,998,139, Patentee: May et al., Issued: Mar. 5, 1991.

U.S. Pat. No. 5,003,351, Patentee: Waki et al., Issued: Mar. 26, 1991.

U.S. Pat. No. 5,010,367, Patentee: Hays, Issued: Apr. 23, 1991.

U.S. Pat. No. 5,021,838, Patentee: Parker et al., Issued: Jun. 4, 1991.

U.S. Pat. No. 5,031,570, Patentee: Hays et al., Issued: Jul. 16, 1991.

U.S. Pat. No. 5,045,893, Patentee: Tabb, Issued: Sep. 3, 1991.

U.S. Pat. No. 5,049,949, Patentee: Parker et al., Issued: Sep. 17, 1991.

The relevant portions of the foregoing patents may be summarized as follows:

U.S. Pat. No. 4,403,848 discloses a multi-color printer wherein the photoconductive member is charged, exposed and developed with toner particles of a first color. Thereafter, the photoconductive member is reexposed, developed with toner particles of a second color and the toner particles of both colors transferred to a sheet. After transferring the toner particles to the sheet, the toner particles are fused thereto.

U.S. Pat. No. 4,660,059 describes an apparatus on which a document is printed in two different colors. Ions are projected onto a dielectric surface to record a first electrostatic latent image thereon. The first electrostatic latent image is developed with toner particles of a first color. Thereafter, the first electrostatic latent image recorded on the dielectric member is substantially neutralized. A second ion projector then projects ions onto the dielectric surface to record another electrostatic latent image. This second electrostatic latent image is then developed with toner particles of a second color. The toner particles of the first color and the second color are transferred from the dielectric member to a sheet and subsequently fused thereto forming a highlight color document.

U.S. Pat. No. 4,761,672 and U.S. Pat. No. 4,771,314 describe a developer apparatus for forming toner images in black and at least one highlighting color in a single pass of the photoreceptor through the use of a tri-level system.

U.S. Pat. No. 4,791,452 and U.S. Pat. No. 4,833,503 describes a system for forming a highlight color copy wherein a photoconductive belt is charged, exposed, and developed to a first toner powder image thereon. Thereafter, the photoconductive belt is recharged, reexposed and developed with toner particles of another color. The toner particles of both colors are then transferred from the photoconductive belt to a sheet and, subsequently, fused thereto, forming a highlight color document.

U.S. Pat. No. 4,833,504 describes a tri-level system using a magnetic brush development apparatus having a plurality of developer housings with the magnetic rolls disposed in the second developer housing being constructed so that the radial component of the magnetic force field produces a magnetically free development zone intermediate the photoconductive surface and the magnetic rolls.

U.S. Pat. No. 4,937,636 describes a printing machine which forms a two-color output copy in a single pass. A latent image is formed having three separate discharge levels corresponding to the black information, color fluorescent areas and the background areas. The black and color areas are developed with appropriately colored toner by developer units biased to the appropriate levels.

U.S. Pat. No. 5,003,351 describes an electrophotographic printing machine which employs a plurality of developer units capable of forming multi-color images and full-color images. Different developer bias voltages are applied to the developer roller so as to match the photoconductive surface properties.

U.S. Pat. No. 5,010,367 describes a development system employing electrode wires disposed in the development zone between the donor roller and the photoconductive surface. Toner particles are transported by the donor roller to the development zone. The electrode wires are electrically biased to detach toner particles from the donor roll forming a toner powder cloud in the development zone. Toner particles from the toner powder cloud develop the electrostatic latent image recorded on the photoconductive surface.

U.S. Pat. No. 5,031,570 describes a scavengeless development system for use in a tri-level printing machine. A first magnetic brush developer unit develops the charged area with black toner particles and a second magnetic brush developer unit having electrically biased electrode wires in the development zone, develops the discharged areas with toner particles of a color other than black.

Pursuant to one aspect of the present invention, there is provided an electrophotographic printing machine adapted to print indicia on a document, including a member having a latent image recorded therein. And, a development system which includes a first donor surface transporting first marking particles and a second donor surface transporting second marking particles, the first donor surface vibrating to develop a first portion of the latent image with the first marking particles with the second donor surface being substantially non-vibrating, the second donor surface vibrating to develop a second portion of the latent image with the second marking particles with the first donor surface being substantially non-vibrating.

Pursuant to another aspect of the present invention, there is provided a developer apparatus for developing a selected portion of a latent image recorded on a photoconductive member in a printing machine including a donor surface transporting marking particles, wherein a first portion of the donor surface vibrates to develop the selected portion of the latent image with the marking particles with a second portion of the donor surface being substantially non-vibrating.

Other aspects of the present invention will become apparent as the following description proceeds and upon reference to the drawings.

FIG. 2A illustrates the (ideal) step in acoustic motion desired at the edge of a development area along with envisioned actual motion without employing active damping;

FIG. 2B illustrates the application of phase shifted voltages to electrodes in the vicinity of the edge which then act as active damping electrodes rather then primary driving electrodes;

FIG. 3 illustrates the development stylus of the present invention;

FIG. 4 is an enlarged portion of FIG. 3 showing details of a single styli of the development stylus.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 5:
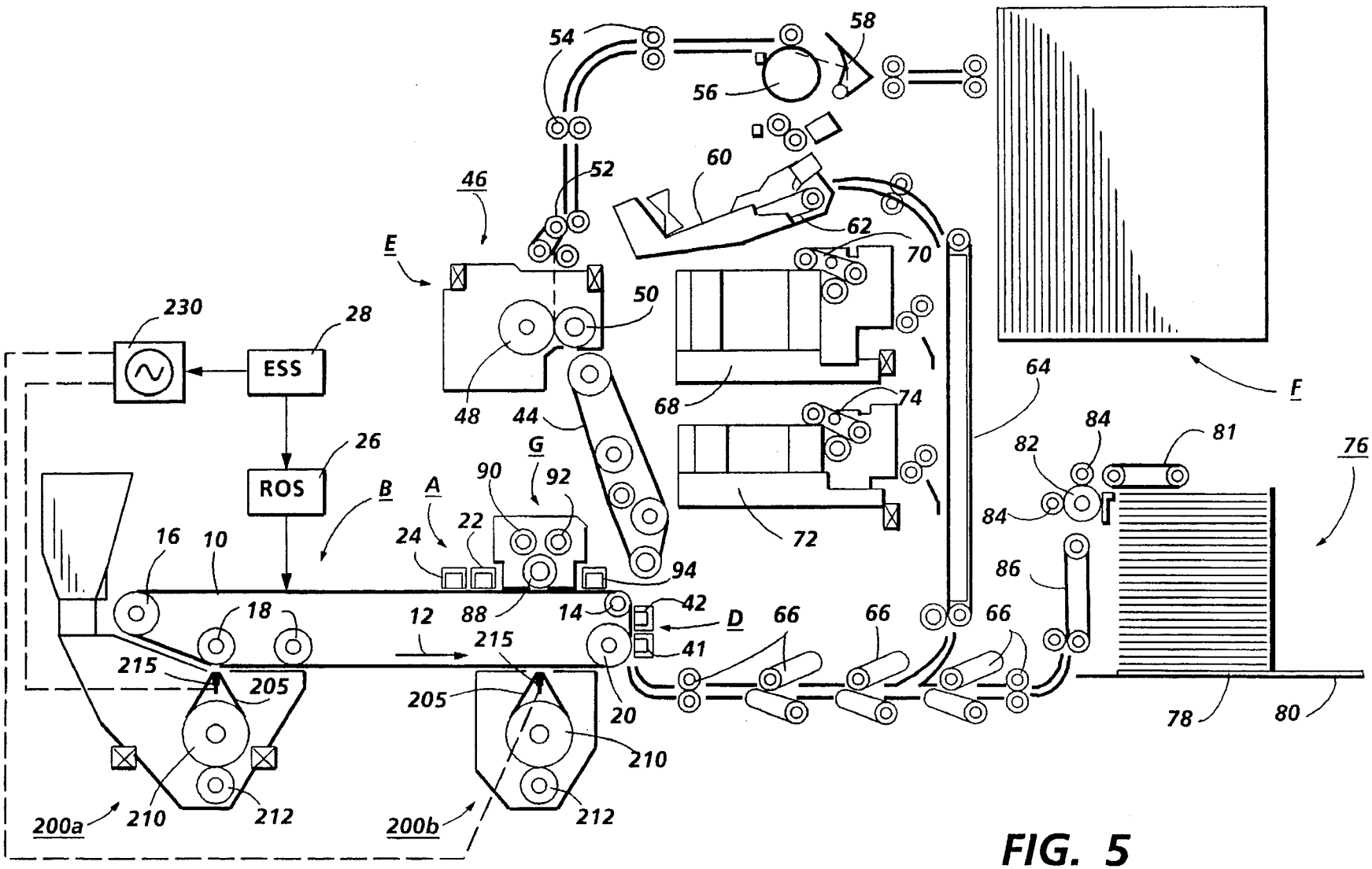
FIG. 5 is a schematic elevational view depicting an illustrative electrophotographic printing machine incorporating the features of the present invention therein.

For a general understanding of the features of the present invention, reference is made to FIG. 5. FIG. 5 schematically depicts an electrophotographic printing machine incorporating the features of the present invention therein. It will become evident from the following discussion that the features of the present invention may be used in a wide variety of printing machines and is not specifically limited in this application to the particular embodiment depicted herein.

Referring now to FIG. 5, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenydiphenylbithenyldiamine dispersed in a polycarbonate. The generation layer is made from trigonal selenium. The grounding layer is made from a titanium coated mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all the required charge on photoconductive belt 10. Corona generating device 24 acts as leveling device, and fills in any areas missed by corona generating device 22.

Next, the charged portion of the photoconductive surface is advanced through imaging station B. At imaging station B, the uniformly charged photoconductive surface is exposed by an imager, such as a laser based input and/or output scanning device 26, which causes the charged portion of the photoconductive surface to be discharged in accordance with the output from the scanning device. The scanning device is a laser raster output scanner (ROS). The ROS performs the function of creating the output image copy on the photoconductive surface. It lays out the image in a series of horizontal scan lines with each line having a certain number of pixels per inch. The ROS may include a laser with rotating polygon mirror blocks and a suitable modulator or, in lieu thereof, a light emitting diode array (LED) as a write bar. An electronic subsystem (ESS) 28 is the control electronics which prepare and manage the image data flow between the data source and the ROS. It may also include a display, user interface and electronic storage, i.e. memory, functions. The ESS is actually a self-contained, dedicated mini computer. The photoconductive surface, which is initially charged to a high charge potential, is discharged imagewise in the background areas and remains charged in the image areas in the black parts of the image. Alternatively, the photoconductive surface can be discharged in the image areas while the background areas remain charged.

As will be understood by those skilled in the xerographic arts, the color developing materials normally consist of a suitable carrier material with relatively smaller color material (referred to as toner). Toner is drawn to the image areas while being repelled in the background areas. The toners employed for multi-color toner images are charged to have the same polarity, and preferably the toner is non-magnetic.

The present invention, development apparatus **200*a* is shown that accomplishes sonic toner release in a non-interactive development process having minimal interactive effects between deposited (developed) toner and subsequently presented toner. The development apparatus 200*a* is a means to achieve multicolor single transfer systems without cross-color contamination of images and/or developer materials (scavenging effects). The development apparatus 200*a* is typical of developing apparatuses of the present invention and comprises a piezoelectric polymer belt 205 as a donor member having a portion thereof closely spaced with respect to belt 10 in what is commonly known as touchdown development. The piezoelectric belt 205 is entrained around roller 210 and development stylus 215. Roller 210 is the driver and is positioned adjacent a magnetic brush toner loading device 220. Belt 205 has a D.C. bias applied to its outside surface by a D.C. source (not shown). The outside surface of the belt includes a conductive coating thereon. An A.C. source 230 applies a bias to development activation stylus 215. Thus, the basic concept of sonic toner release is achieved by locally reducing the net force of adhesion of toner to the loaded donor surface by acoustic agitation of the donor surface by A.C. source 230**. Sufficient reduction of the net force of adhesion of toner to the donor surface enables $_qE$ electrostatic forces to selectively remove toner from the donor and transport it to desired areas of development on the receptor.

In sonic toner release development, use is made of motions of a charged particle bearing surface (donor) to controllably counter forces adhering the particles to the surface. These motions can be adjusted in magnitude such that particles continue to adhere to the donor surface unless they are additionally effected by an electric field of appropriate direction and magnitude to remove them from the donor. In the case wherein the electric field is due to proximity of an electrostatic image, the released toner will selectively traverse to the image, thereby developing it.

The selective toner removal characteristics of sonic toner release development distinguish it from powder cloud (and jumping) development where airborne toner is presented to the entire receptor regardless of it's potential. This distinction provides an important copy quality advantage with sonic toner release since wrong sign and un-charged toner deposition is inhibited. In addition, interaction effects between successive developments with different toners (colors) are minimal. Development system advantages obtained with single transfer and enabled by non-interactive development include simplified (on the receptor) registration of images, increased thruput, and reduced system complexity.

Development activated stylus 215 of the present invention is activated by the ESS in both the process direction and orthogonal to the process direction by controlling both the timing and the inboard/outboard locations of acoustic motions imparted to multiple development activation styluses, localized areas of development are defined to selectively develop a single latent electrostatic image with selected highlight colors. Development stylus 215 has only relatively low resolution development area addressability in the cross process direction of order 0.010 inch, for example, for typical highlight colored business documents. It should be evident that if higher cross process resolution was desired one could increase the number of addressable styli. Addressability in the process direction depends upon the precision of timing and the time response of the acoustic excitation of the donor surface. The addressability of the development stylus determines how close adjacent image areas of different colors may be.

The development stylus of the present invention employs an electrode array which is incorporated to enable the desired control of areas of acoustic motion of the donor belt. An advantage of this electrode array is the ability to introduce "active damping" of motion at the edges of development areas by applying appropriately phase shifted voltages to electrodes in the vicinity of the edges. This technique is used to suppress/reduce noise at audio frequencies, and it should be applicable to ultrasonic frequencies as well.

FIG. 2A shows the (ideal) step in acoustic motion desired at the edge of a development area along with envisioned actual motion without employing active damping. FIG. 2B illustrates the application of phase shifted voltages to electrodes in the vicinity of the edge which then act as active damping electrodes rather then primary driving electrodes.

The electrode array also provides control of acoustic motion locations orthogonal to the process direction. With reference to FIGS. 3 and 4, passive acoustic damping material 5 is positioned upstream and downstream of each individual electrode 6 to limit the active donor area in that direction. Height of electrodes 6 "d" determines the minimum length of developed area in the process direction while timing and driving voltage applications to electrodes 6 controlled by the ESS determines the actual location of developed area edges. FIG. 4 is an enlarged drawing showing details of a single electrode of the development stylus engaged with the donor belt.

Having in mind the construction and the arrangement of the principal elements thereof, it is believed that a complete understanding of the development stylus may be now had from a description of its operation.

Figure 1A:
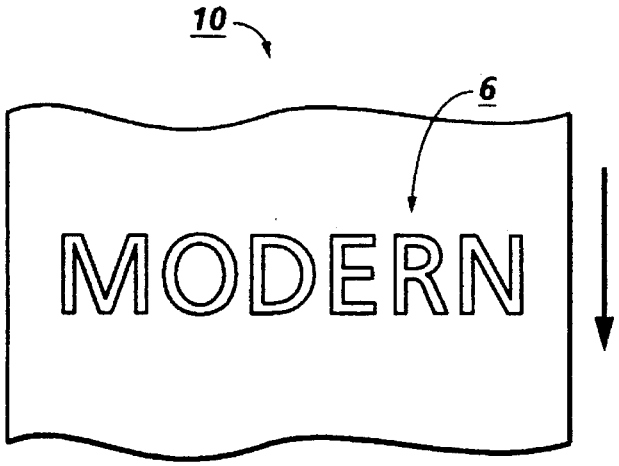
FIGS. 1A–1C illustrates exemplary modes of development of a latent image employing the teaching of the present invention.
Figure 1B:
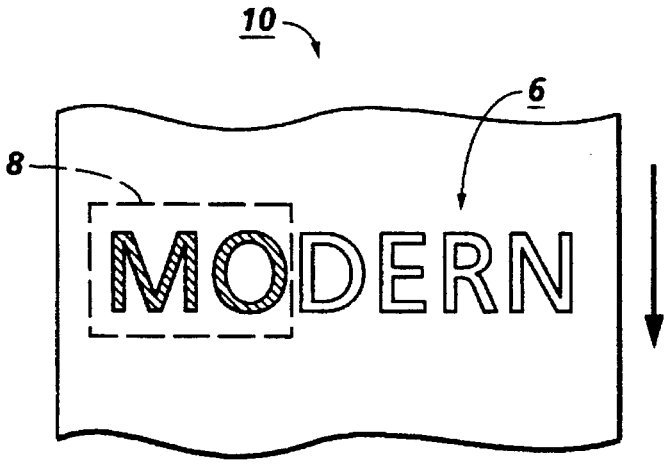
Figure 1C:
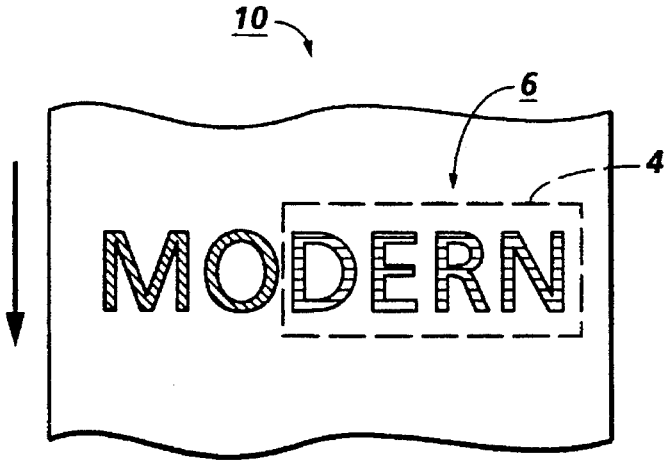

Referring to FIGS. 1A–C which illustrates sequential development of a single latent electrostatic image (FIG. 1A) by two development apparatus. As the latent image passes by development apparatus 200*a*, the ESS controls each individual electrode of development stylus 215*a* so that toner (i.e. black toner) is only released in area 8 (FIG. 1B). As the partial developed latent image passes by development apparatus 200*b*, the ESS controls each individual electrode of development stylus 215*b* so that different color toner (i.e. red toner) is only released in area 4 (FIG. 1C). It is preferred that ESS has a color controller to control the development stylus so that reproduced (output) images have the same color as scanned input image. Alternatively, an edit pad can be employed with the ESS to select areas on the original to be copied in a desired color.

After the latent image is selectively developed with black toner particles and with toner particles of a color other than black, belt 10 advances the resultant toner powder image to transfer station D. At transfer station D, a sheet or document is moved into contact with the toner powder image. Thus, photoconductive belt 10 is exposed to a pre-transfer light from a lamp (not shown) to reduce the attraction between the photoconductive belt and the toner powder image. Next, a corona generating device 41 charges the sheet to the proper magnitude and polarity as the sheet is passed through photoconductive belt 10. The toner powder image is attracted from photoconductive belt 10 to the sheet. After transfer, a corona generator 42 charges the sheet to the opposite plurality to detack the sheet from belt 10. Conveyor 44 advances the sheet to fusing station E.

Fusing station E includes a fuser assembly indicated generally by the reference numeral 46, which permanently affixes the transferred toner powder image to the sheet. Preferably, fuser assembly 46 includes a heated fuser roll 48 and a pressure roll 50 with the powder image on the sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the sheets are fed through a decurler 52. Decurler 52 bends the sheet in a first direction and puts a known curl in the sheet, and then bends it in the opposite direction to remove that curl.

Forwarding rollers 54 than advance the sheet to duplex turn roll 56. Duplex solenoid gate 58 guides the sheet to the finishing station F or to duplex tray 60. At finishing station F, sheets are stacked in a compiler to form sets of cut sheet. The sheets of each set are optionally stapled to one another. The set of sheets are then delivered to a stacking tray. In a stacking tray, each set of sheets may be offset from an adjacent set of sheets.

With continued reference to FIG. 5, duplex solenoid gate 58 directs the sheet into duplex tray 60. Duplex tray 60 provides an intermediate or buffer storage for those sheets that have been printed on one side on which an image will be subsequently printed on the second, opposed side thereof, i.e. the sheets being duplexed. The sheets are stacked in duplex tray 60 face down on top of one another in the order in which they are being printed.

In order to complete duplex printing, the simplex sheets in tray 60 are fed, in seriatim, by bottom feeder 62 from tray 60 back to transfer station D via a conveyor 64 and rollers 66 for transfer of the toner powder image to the opposed side of the sheet. Inasmuch as successive sheets are fed from duplex tray 60, the proper or clean side of the sheet is positioned in contact with belt 10 at transfer station D so that the toner powder image is transferred thereto. The duplex sheet is then fed through the same path as the simplex sheet to be advanced to finishing station F.

Sheets are fed to transfer station D from secondary tray 68. Secondary tray 68 includes an elevator driven by a bi-directional AC motor. Its controller has the ability to drive the tray up or down. When the tray is in the down position, stacks of sheets are loaded thereon or unload therefrom. In the up position, successive sheets may be fed therefrom by sheet feeder 70. Sheet feeder 70 is a friction retard feeder utilizing a feed belt and take-away rolls to advance successive sheets to transport 64 which advances the sheets to rolls 66 and then to transfer station D.

Sheets may also be fed to transfer station D from the auxiliary tray 72. Auxiliary tray 72 includes an elevator driven by a bi-directional AC motor. Its controller has the ability to drive the tray up or down. When the tray is in the down position, stacks of sheets are loaded thereon or unloaded therefrom. In the up position, successive sheets may be fed therefrom by sheet feeder 74. Sheet feeder 74 is a friction retard feeder utilizing a feed belt and take-away rolls to advance successive sheets to transport 64 which advances the sheets to rolls 66 and to transfer station D.

Secondary tray 68 and auxiliary tray 72 are secondary sources of sheets. A high capacity feeder indicated generally by the reference numeral 76, is the primary source of sheets. High capacity feeder 76 includes a tray 78 supported on elevator 80. The elevator is driven by a bi-directional AC motor to move the tray up or down. In the up position, the sheets are advanced from the tray to transfer station D. A fluffer and air knife directs air onto the stack of sheets on tray 78 to separate the uppermost sheet from the stack of sheets. A vacuum pulls the uppermost sheet against the belt 81. Feed belt 81 feeds successive uppermost sheets from the stack to a take-away drive roll 82 and idler rolls 84. The drive rolls and modular rolls guide the sheet onto transport 86. Transport 86 advances the sheet to roll 66 which, in turn, move the sheet to transfer station D.

Invariably, after the sheet is separated from photoconductive belt 10, some residual toner particles remain adhering thereto. After transfer, photoconductive belt 10 passes beneath corona generating device 94 which charges the residual toner particles to the proper polarity. Thereafter, the pre-charge array lamp (not shown), located inside photoconductive belt 10 discharges the photoconductive belt in preparation for the next imaging cycle. Residual particles are removed from the photoconductive surface at cleaning station G.

Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper, debris and wrong sign toner particles. The toner particles on the reclaim roll are scrapped off and deposited in a reclaim auger (not shown), where it is transported out of the rear of the cleaning station G.

While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A printing machine adapted to print indicia on a document, including:

a member having a latent image recorded thereon; and a development system comprising a first donor surface transporting first marking particles and a second donor surface transporting second marking particles, said first donor surface vibrating to develop a first portion of the latent image with the first marking particles with said second donor surface being substantially non-vibrating, said second donor surface vibrating to develop a second portion of the latent image with the second marking particles with said first donor surface being substantially non-vibrating.

2. The printing machine of claim 1, wherein:

said first donor surface comprises a first piezoelectric polymer belt spaced from said member; and said second donor surface comprises a second piezoelectric polymer belt spaced from said member.

3. The printing machine of claim 2, further comprising:

a first developer stylus for vibrating said first piezoelectric polymer belt adjacent to the first portion of the latent image; and a second developer stylus for vibrating said second piezoelectric polymer belt adjacent to the second portion of the latent image.

4. A printing machine of claim 1, further comprising means for selecting the first portion and second portion of the latent image.

5. A printing machine of claim 4, wherein the first marking particles are black in color, and the second marking particles are non-black in color.

6. A printing machine of claim 1, wherein the first marking particles are of a different color than the second marking particles.

7. The printing machine of claim 1, further comprising:

means for transferring the first and second marking particles from said member to the document; and means for substantially permanently fusing the first and second marking particles to the document to form the indicia on the document.

8. A printing machine adapted to print indicia on a document, including:

a member having a latent image recorded thereon; and a development system comprising:

a first donor surface transporting first marking particles, said first donor surface comprises a first piezoelectric polymer belt spaced from said member;

a second donor surface transporting second marking particles, said second donor surface comprises a second piezoelectric polymer belt spaced from said member, said first donor surface vibrating to develop a first portion of the latent image with the first marking particles with said second donor surface being substantially non-vibrating, said second donor surface vibrating to develop a second portion of the latent image with the second marking particles with said first donor surface being substantially non-vibrating;

a first developer stylus for vibrating said first piezoelectric polymer belt adjacent to the first portion of the latent image, said first stylus comprises a first array of individually addressable electrodes; and a second developer stylus for vibrating said second piezoelectric polymer belt adjacent to the second portion of the latent image, said second stylus comprises a second array of individually addressable electrodes.

9. The printing machine of claim 8, wherein the member moves in a predetermined direction of movement, further comprising control means, responsive to movement of said member, for selectively actuating individual electrodes in said first array and said second array so that the first portion and the second portion of the latent image are developed orthogonally and in the direction of movement of said member.

10. The printing machine of claim 9, wherein:

said first array comprises a first damping material interposed between each electrode thereof; and said second array comprises a second damping material interposed between each electrode thereof.

11. A developer apparatus for developing a selected portion of a latent image recorded on a member, comprising a donor surface for transporting marking particles, wherein a first portion of said donor surface vibrates to develop the selected portion of the latent image with the marking particles with a second portion of said donor surface being substantially non-vibrating.

12. The developer apparatus of claim 11, wherein said donor surface comprises a piezoelectric polymer belt spaced from said member.

13. The developer apparatus of claim 12, further comprising a developer stylus for vibrating said piezoelectric polymer belt adjacent to the first portion of the latent image.

14. A developer apparatus for developing a selected portion of a latent image recorded on a member, comprising:

a donor surface for transporting marking particles, wherein a first portion of said donor surface vibrates to develop the selected portion of the latent image with the marking particles with a second portion of said donor surface being substantially non-vibrating, said donor surface comprises a piezoelectric polymer belt spaced from said member; and a developer stylus for vibrating said piezoelectric polymer belt adjacent to the first portion of the latent image, said stylus comprises an array of individually addressable electrodes.

15. The developer apparatus of claim 14, wherein the member moves in a predetermined direction of movement, further comprising control means, responsive to movement of said member, for selectively actuating individual electrodes in said array so that the selected portion of the latent image is developed orthogonally and in the direction of movement of said member.

16. The developer apparatus of claim 15, wherein said array comprises a damping material interposed between each electrode thereof.

* * * * *